United States Patent [19]

Gustafson

[11] Patent Number: 4,925,060

[45] Date of Patent: May 15, 1990

[54] CORK FOR CRYOGENIC DRY SHIPPER

[76] Inventor: Keith W. Gustafson, Station 1101, Lake Arrowhead, Waleska, Ga. 30183

[21] Appl. No.: 395,327

[22] Filed: Aug. 17, 1989

[51] Int. Cl.[5] ..... B65D 51/16

[52] U.S. Cl. ..... 220/371; 220/366; 220/901; 215/364; 62/47.1

[58] Field of Search ..... 220/308, 358, 366, 371, 220/372, 378, 901, 85 VS; 215/308, 364; 62/47.1, 53.2

[56] References Cited

U.S. PATENT DOCUMENTS

| | | | |
|---|---|---|---|
| 2,419,743 | 4/1947 | Taylor | 215/364 |
| 2,986,891 | 6/1961 | McMahon | 62/47.1 |
| 3,033,408 | 5/1962 | Joud | 215/364 X |
| 3,298,185 | 1/1967 | Loudon | 220/901 X |
| 3,938,346 | 2/1976 | Ovchinnikov et al. | 62/47.1 |
| 4,259,846 | 4/1981 | Rudolphi et al. | 220/85 VS X |
| 4,337,624 | 7/1982 | Hamon | 220/901 X |

*Primary Examiner*—Stephen Marcus
*Assistant Examiner*—Nova Stucker
*Attorney, Agent, or Firm*—Jones, Askew & Lunsford

[57] ABSTRACT

There is disclosed an atmospheric pressure dewar with an improved closure for the neck opening. The improvement comprises a cork positioned in the neck opening with a fibrous material occupying the peripheral space between the neck opening and the cork to inhibit convection flow of gases in the peripheral space when the dewar is oriented other than in the upright position.

2 Claims, 2 Drawing Sheets

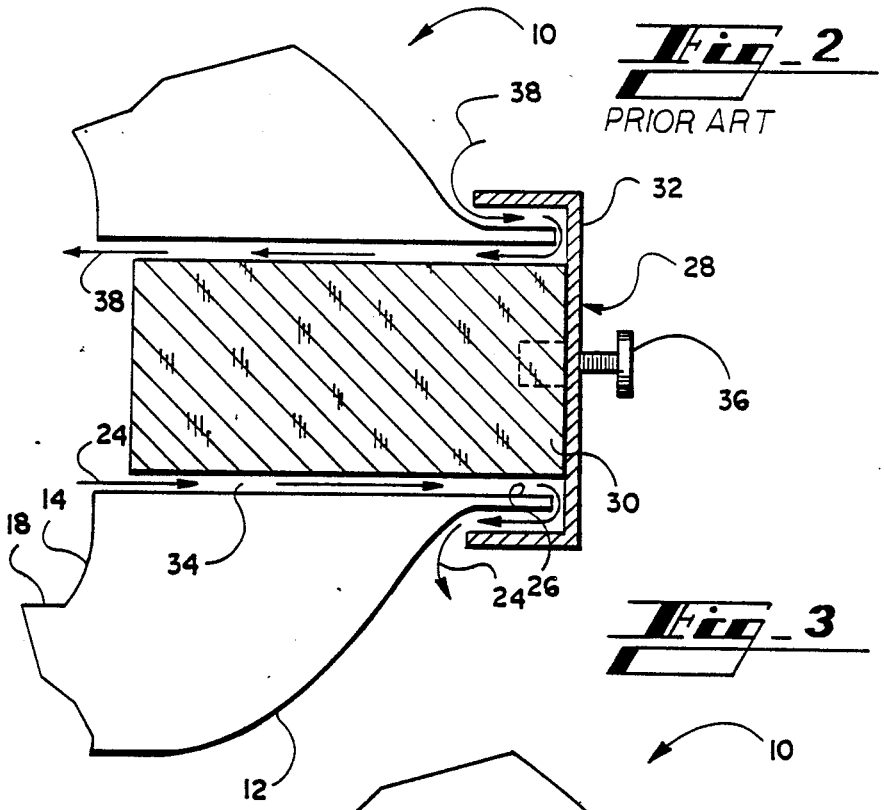
Fig_2
PRIOR ART
Fig_3
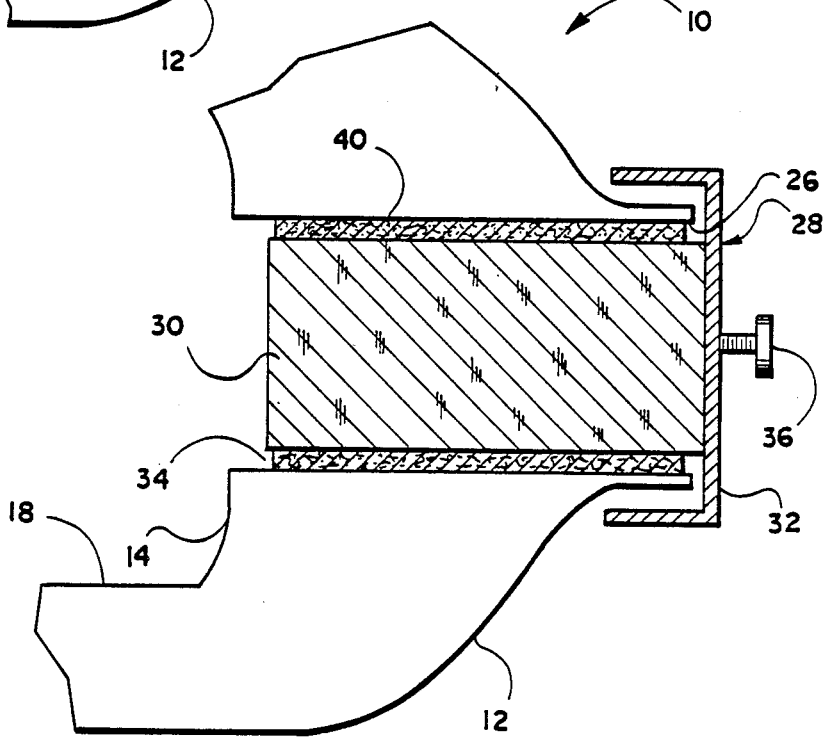

CORK FOR CRYOGENIC DRY SHIPPER

BACKGROUND OF THE INVENTION

This invention relates generally to cryogenic dry shippers, and more particularly concerns a closure for closing the top opening of such dry shippers.

Dry shippers are atmospheric pressure cryogenic dewars that hold a liquid cryogen in an absorbent material so that the cryogenic liquid does not come in contact with the contents of the dry shipper. Dry shippers are generally used to ship frozen biological samples by common carriers and are designed to keep the samples frozen until they arrive at their destination.

Because such dry shippers are shipped by common carriers, they may be shipped in all attitudes despite the "this side up" labels on the shipping cartons. When a dry shipper is placed on its side or inverted, the holding time, the time in which the sample remains frozen, is dramatically reduced. The reason for degradation in the dry shipper's performance is the design of the dewar closure. In a conventional dry shipper, the neck opening is closed with a cork. The cork is constructed of an insulating material such as styrofoam that blocks outside heat from entering the open neck tube. The cork is fitted to the neck tube so that there is an peripheral space around the cork that allows for escape of gas to alleviate pressure as the cryogenic liquid evaporates from the absorbent material. The styrofoam cork with the peripheral space works fine while the dry shipper is upright because cold gas rests in the bottom of the dewar and has no path out. When the dry shipper, however, is tipped on its side or inverted, the cold gas can now flow along the bottom of the pressure relief peripheral space between the neck tube and the cork and be replaced by warm gas flowing in the peripheral space along the top of the cork. This convection flow, resulting from the differences in density between the cold gas adjacent the bottom of the peripheral space and the warm gas adjacent the top of the peripheral space, rapidly warms the inside of the dewar and decreases its holding time.

SUMMARY OF THE INVENTION

It is therefore an object of the present invention to provide an improved dewar closure for a cryogenic dry shipper.

It is likewise an object of the present invention to provide an improved cork for a dewar closure that inhibits convection currents in the peripheral space around the cork that occur when the dry shipper is tipped on its side or inverted.

In order to accomplish the foregoing objectives, a fibrous filler material is introduced into the peripheral space around the cork. The fibrous material is sufficiently porous to allow for the escape of gas to alleviate any undesirable pressure build up. On the other hand the fibrous material has sufficient fibrous mass to break up and inhibit any convection currents that may be induced in the peripheral space.

Other objects and advantages of the invention will become apparent upon reading the following detailed description and upon reference to the drawings.

BRIEF DESCRIPTION OF THE DRAWINGS

FIG. 2 is a detailed view, partly in cross-section, of the dewar closure for the dry shipper in accordance with the prior art; and FIG. 3 is a detailed view, partly in cross-section, of an improved dewar closure for a cryogenic dry shipper in accordance with the present invention.

DETAILED DESCRIPTION OF THE INVENTION

Figure 1:
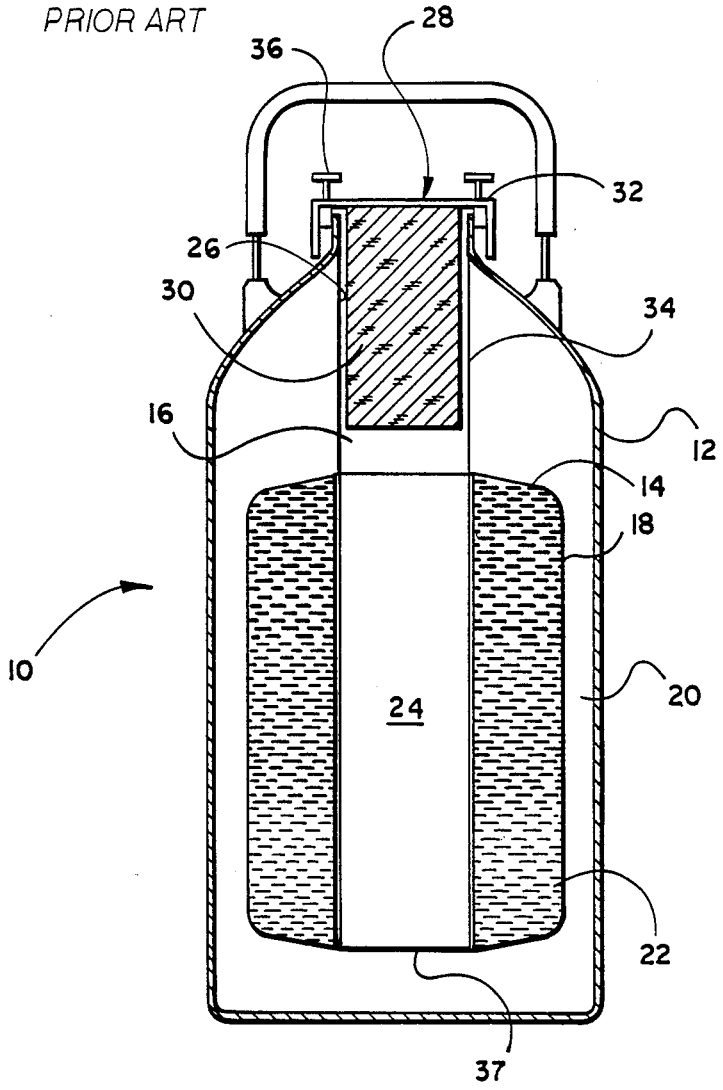
Fig. 1 PRIOR ART
FIG. 1 is an elevation view, partly in vertical cross-section, showing a cryogenic dry shipper made in accordance with the prior art.

While the invention will be descried in connection with a preferred embodiment, it will be understood that I do not intend to limit the invention to that embodiment. On the contrary, I intend to cover all alternatives, modifications, and equivalents as may be included within the spirit and the scope of the invention as defined by the appended claims.

Turning to FIG. 1, there is shown a cryogenic dry shipper or dewar 10 comprising an outer vessel 12 and an inner vessel 14. The inner vessel 14 is suspended within the outer vessel 12 by means of a neck tube 16. An insulating space 20 located between the inner vessel 14 and the outer vessel 12 is evacuated to create a vacuum and is insulated thereby minimizing the amount of heat transferred from the ambient atmosphere outside of the dewar 10 to the contents of the inner vessel 14. The inner vessel 14 contains an absorbent material 22 which can absorb and hold a liquid cryogen. As a result of the liquid cryogen in the absorbent material 22, the remainder of the interior space of the inner vessel 14 is occupied by cold gas 24 which maintains the interior of the inner vessel at temperatures well below freezing. Where the liquid cryogen is liquid nitrogen, the cold gas within inner vessel 14 will provide an interior temperature of approximately −320° F.

The neck tube 16 has a neck opening 26 which allows for the introduction into the inner vessel of both the liquid cryogen and biological samples or other materials that are to be stored and transported in the dry shipper 10. In order to maintain the interior of the inner vessel 14 at a low temperature for as long as period as possible, it is necessary to provide a dewar closure 28 at the neck opening 26. The dewar closure 28 comprises a cork 30, a cap 32, and a peripheral space 34 around the cork 30. The cork 30 is generally an insulative material such as styrofoam which serves to block outside heat from entering the neck opening 26 of the neck tube 16. The cap 32 is provided to hold the cork 30 in place by some suitable mechanical means, such as thumb screws 36. The peripheral space 34 allows for the escape of gas in order to alleviate pressure that builds up as the liquid cryogen evaporates from the absorbent material 22.

As long as the dewar 10 remains in its upright position as shown in FIG. 1, the cold gas 24 sinks to the bottom 37 of the inner vessel 14 and has no flow path out of the inner vessel 14. Consequently, the holding time for the dewar, the time it takes for the dewar to rise above the freezing point of the sample stored therein, depends primarily on the very low heat transfer paths through the insulating space 20, the insulating cork 30, and the static gas in the peripheral space 34. Consequently, such a dewar may have a static holding time of as much as 12 days when oriented in its upright position.

Turning to FIG. 2, there is shown the neck opening 26 and dewar closure 28 with the dewar 10 oriented so that it is on its side. With the dewar 10 on its side, the cold gas 24 inside the inner vessel 14 spreads out across side 18 of the inner vessel 14 and comes in contact with the peripheral space 34 around the cork 30. At the same time, warm gas 38 comes in contact with the peripheral space outside of the dewar 10. Because of the difference in density between the cold gas 24 and the warm gas 38, the cold gas flows downwardly through the bottom of the peripheral space 34 and out of the neck opening 26. Likewise, the warm gas 38 flows upwardly through the peripheral space 34 on top of the cork 30 and into the inner vessel 14. The convection flow just described, rapidly replaces the cold gas 24 with the warm gas 38 thereby decreasing the static holding time of the dewar. Particularly, a dewar with liquid nitrogen as the cryogen is capable of achieving a static holding time of 12 days when oriented upright. When the same dewar is tipped on its side, it will only provide a static holding time of approximately 6 days.

In order to overcome the loss of holding time which results from convection flow around the peripheral space 34 of the cork 30 when the dewar is tipped on its side or inverted, I have found that the convection currents described in connection with FIG. 2 can be broken up and essentially eliminated by providing a fibrous material 40 around the cork 30 in the peripheral space 34. Turning to FIG. 3 the dewar 10 is the same as previously described except that the fibrous material 40 has been positioned in the peripheral space 34 around the cork 30. The fibrous material may include a number of materials such as polyester fleece fabric, felt, cotton, and even steel wool. Based on price and performance, polyester fleece material is preferred.

The unexpected results of the present invention are illustrated by comparing the performance of a dewar having a conventional dewar closure comprising a cork with the performance of a dewar having a dewar closure comprising a cork and fibrous material in the peripheral space between the cork and the neck opening. Three similar dewars were oriented in the upright position. Two were fitted with a conventional dewar closure comprising only a cork. The third dewar was fitted with a cork wrapped with a polyester fleece fabric. The rate of gas escape was measured in pounds per day for each dewar over several days to establish an average. The same three dewars were then oriented on their sides, and the rate of gas escape was similarly measured. The results are shown in Table 1 below:

| Dewar | Upright | Side |
|---|---|---|
| Present Invention | 0.300 lb/day | 0.300 lb/day |
| Conventional 1 | 0.300 lb/day | 0.450 lb/day |
| Conventional 2 | 0.300 lb/day | 0.720 lb/day |

As can be seen from the results reported in Table 1, the dewar of the present invention lost gas at the same rate whether oriented upright or on its side. On the other hand, the dewars with the conventional closures lost gas at a rate of between 50% and 125% faster when oriented on their sides. The faster loss of gas is directly proportional the holding time for the dewar. Consequently, the dewar of the present invention provides remarkably improved performance over conventional dewars with conventional closures.

I claim:

1. In an atmospheric pressure dewar having an outer vessel and an inner vessel with an insulating space between the inner and outer vessels, having an absorbent material in the inner vessel for holding a liquid cryogen, and having a neck tube with a neck opening for providing access to the interior of the inner vessel from outside the outer vessel, the improvement comprising closure means for the neck opening comprising an insulative cork for insertion through the neck opening into the neck tube and position and sized to provide an peripheral space around the cork and a fibrous material in the peripheral space, the fibrous material having a fibrous mass sufficient to inhibit convection flow of gas in the peripheral space and having a porosity sufficient to allow the escape of gas pressure resulting from the evaporation of the liquid cryogen inside the inner vessel.

2. The dewar of claim 1, wherein the fibrous material is a polyester fleece fabric.

* * * * *